US007721436B2

(12) United States Patent
Prociw et al.

(10) Patent No.: US 7,721,436 B2
(45) Date of Patent: May 25, 2010

(54) METHOD OF MANUFACTURING A METAL INJECTION MOULDED COMBUSTOR SWIRLER

(75) Inventors: Lev Alexander Prociw, Elmira (CA); Harris Shafique, Longueuil (CA); Aleksander Kojovic, Oakville (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1190 days.

(21) Appl. No.: 11/311,145

(22) Filed: Dec. 20, 2005

(65) Prior Publication Data

US 2007/0137208 A1 Jun. 21, 2007

(51) Int. Cl.
*B21K 25/00* (2006.01)

(52) U.S. Cl. ..... 29/889.22; 29/889.2; 60/740; 60/776

(58) Field of Classification Search ..... 29/889.2, 29/889.22; 60/740, 776; 419/6, 8
See application file for complete search history.

(56) References Cited

U.S. PATENT DOCUMENTS

| | | | | |
|---|---|---|---|---|
| 1,751,448 | A | 3/1930 | Campbell, Jr. | |
| 2,468,824 | A | 5/1949 | Hughey | |
| 3,413,704 | A | 12/1968 | Addoms, Jr. et al. | |
| 3,595,025 | A | 7/1971 | Stockel et al. | |
| 3,615,054 | A | 10/1971 | Botz | |
| 3,704,499 | A | 12/1972 | Majkrzak et al. | |
| 3,790,086 | A | 2/1974 | Masai | |
| 3,831,854 | A | 8/1974 | Sato et al. | |
| 3,925,983 | A | 12/1975 | LBotz | |
| 4,347,982 | A | 9/1982 | Wright | |
| 4,535,518 | A | 8/1985 | Jaqua | |
| 5,450,724 | A | 9/1995 | Kesseli et al. | |
| 5,472,143 | A | 12/1995 | Bartels et al. | |
| 5,547,094 | A | 8/1996 | Bartels et al. | |
| 5,579,645 | A | 12/1996 | Prociw et al. | |
| 5,609,655 | A | 3/1997 | Kesseli et al. | |
| 6,082,113 | A | 7/2000 | Prociw et al. | |
| 6,119,459 | A | 9/2000 | Gomez et al. | |
| 6,289,677 | B1 | 9/2001 | Prociw et al. | |
| 6,321,449 | B2 | 11/2001 | Zhao et al. | |
| 6,560,964 | B2 | 5/2003 | Steinhorsson et al. | |
| 6,863,288 | B2 | 3/2005 | Mao et al. | |
| 6,883,332 | B2 * | 4/2005 | Steinthorsson et al. | 60/776 |
| 7,241,416 | B2 * | 7/2007 | Sweetland | 419/8 |

* cited by examiner

*Primary Examiner*—Rick K Chang
(74) *Attorney, Agent, or Firm*—Ogilvy Renault LLP

(57) ABSTRACT

A combustor swirler for a gas turbine engine and method of manufacturing by metal injection molding an inner component and an outer cylindrical component. Indentations are molded in one of the inner and outer components and sealed by the engagement of the components together to form a series of fluid flow passages. The inner and outer components are molded with interlocking features for ensuring proper alignment of the components during assembly.

14 Claims, 4 Drawing Sheets

METHOD OF MANUFACTURING A METAL INJECTION MOULDED COMBUSTOR SWIRLER

TECHNICAL FIELD

The invention relates generally to a combustor for gas turbine engines and, more particularly, to a combustor swirler and method of manufacturing same.

BACKGROUND OF THE ART

Gas turbine engine combustor air swirlers are exposed to a hot, corrosive environment. It is therefore necessary that they be fabricated of special high temperature alloys. Conventionally employed swirler manufacturing techniques include casting and/or milling combined with subsequent machining steps such as drilling and deburring. Due to the aerodynamic function of the component, care is required to ensure a suitable air flow is produced through the device. However, the special materials employed are not easily cast nor machined. A major disadvantage of casting lies in the difficulty of attaining the close tolerances required for the type of metallic seals involved.

Still further, most swirlers include critical guide air metering holes that are typically drilled one by one; thus, entailing a lengthy time consuming process that is expensive. Also, substantial effort is involved in deburring the holes which further increases costs. Not only does manual finishing considerably raise costs and require great precision to complete, but the result is variable due to its manual nature. It can be concluded that conventional machining, drilling and finishing operations for manufacturing combustor swirlers are time and cost ineffective. Consequently, the swirlers are undesirably expensive to manufacture by conventional means. Therefore, opportunities for cost-reduction exist.

SUMMARY OF THE INVENTION

It is therefore an object of this invention to provide an improved aerodynamic combustor swirler for a gas turbine engine which addresses the above-mentioned issues.

In one aspect, the present invention provides a combustor air swirler comprising: a metal injection moulded outer component, a metal injection moulded inner component concentrically assembled to the outer component such that an annular gap is defined therebetween, the annular gap having an opening defined between a first end of the inner component and the outer component, a series of indentations provided in a first one of said inner and outer components, the indentations being sealed by a sealing surface provided on a second one of said inner and said outer components to form a series of fluid flow passages in flow communication with the annular gap.

In another aspect, the present invention provides method of manufacturing a combustor swirler for a gas turbine engine comprising: metal injection moulding an inner component, the inner component defining an inner cavity adapted to receive a fuel nozzle, metal injection moulding an outer component adapted to be fitted over the inner component; one of said inner and said outer components being moulded with a series of slots in a surface thereof, sealing the slots to form corresponding fluid flow passages by assembling the inner component coaxially with the outer component.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
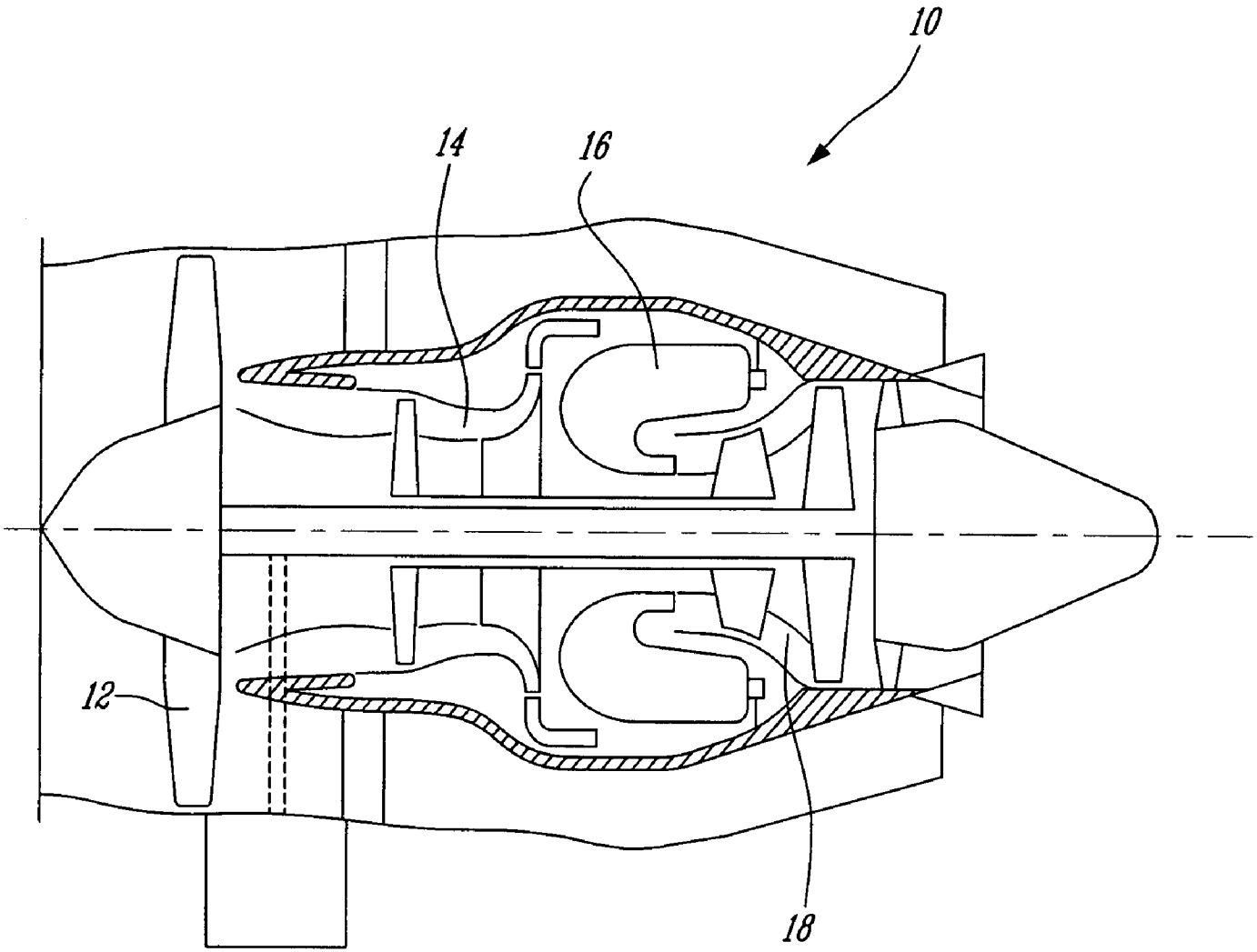
FIG. 1 is a schematic view of a gas turbine engine, in partial cross-section.

FIG. 1 illustrates a gas turbine engine 10 according to one embodiment of the present invention, the gas turbine engine generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
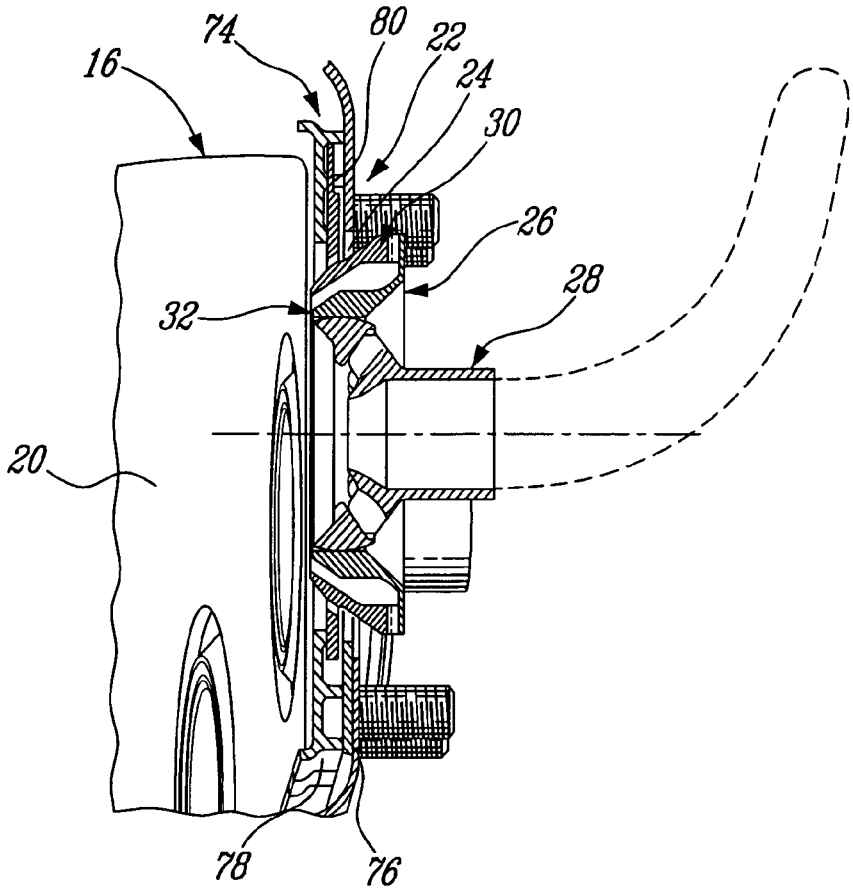
FIG. 2 is a perspective view of a combustor swirler, in accordance with a first embodiment of the present invention, engaged with a fuel nozzle and mounted into an opening in a dome of a combustion chamber of the gas turbine engine of FIG. 1.

FIG. 2 illustrates the combustor 16 having a combustion chamber 20 and an annular combustor dome 22 defining an opening 24 therein. An embodiment of a combustor swirler 26 is illustrated mounted in the opening 24 of the combustor dome 22 and engaged with a fuel nozzle 28. In use, the combustor swirler, which is an aerodynamic component, receives and mixes pressurized air from the compressor 14 with fuel that it receives from the fuel nozzle 28. Notably, imparting an aerodynamic swirl to the fuel and to the air yields a relatively high degree of air-fuel blending. The fuel and air mixture is discharged from the swirler 26 to pass through the dome 22 into the combustor 16 wherein it is conventionally ignited for generating the hot combustion gases. Thus, the expanding gases caused by the fuel ignition drives the turbine 18 in a manner well known in the art.

Notably, the combustor 16 may take any conventional form, and typically includes a plurality of swirlers and respective fuel nozzles. In such an arrangement, the swirlers and fuel nozzles are generally equally spaced about the combustion chamber 20 and must supply exactly the same quantity of fuel and impart the correct aerodynamic effect in order to permit a substantially uniform temperature distribution to promote efficient burning of the fuel in the combustion chamber.

Now referring concurrently to FIGS. 2 to 5, the combustor swirler 26 is illustrated comprising an outer and an inner cylindrical component 30 and 32 respectively. The outer component 30 has first and second peripheral edges 34 and 36 respectively and exterior and interior surfaces 38 and 40 respectively. The outer component 30 defines an axial bore 42 circumscribed by the aerodynamic interior surface 40.

Figure 3:
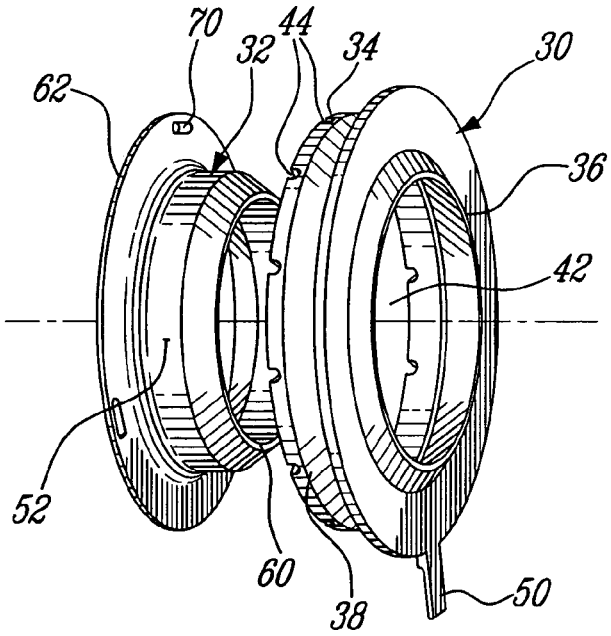
FIG. 3 is an exploded view of the combustor swirler of FIG. 2, showing a first perspective of inner and outer cylindrical components thereof.
Figure 4:
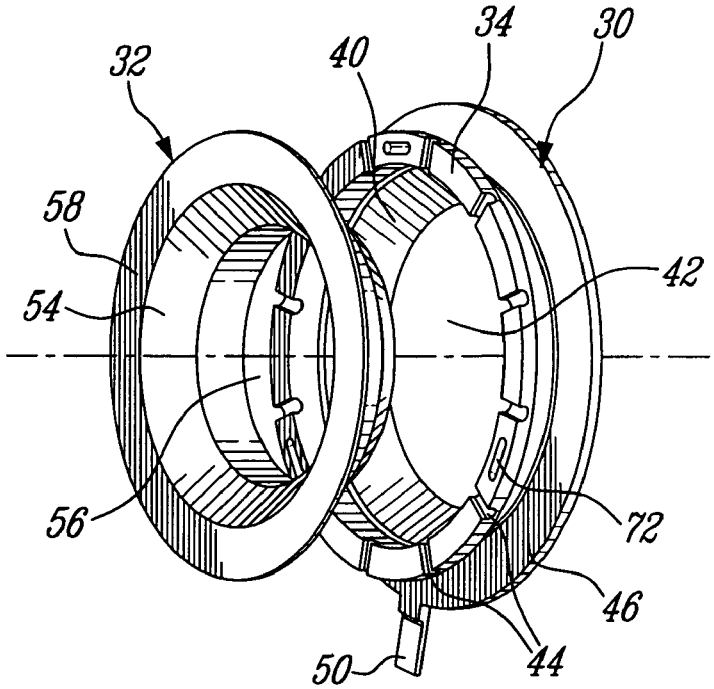
FIG. 4 is an exploded view of the combustor swirler of FIG. 2, showing a second perspective of the inner and outer cylindrical components thereof.

Referring particularly to FIGS. 3 and 4, the outer cylindrical component 30 comprises a plurality of aerodynamic indentations 44 circumferentially defined along the first peripheral edge 34 extending from the exterior surface 38 to the interior surface 40. The indentations 44 can be provided as rounded slots, and more specifically U-shaped slots.

The outer component 30 comprises a mounting flange 46 disposed proximal to the second peripheral edge 36 extending from the exterior surface 38. The mounting flange 46 includes a plurality of holes 48 enabling fluid flow communication for purging the combustor dome region and preventing re-circulation or entrainment of hot gases back to the dome 22. The holes 48 are circumferentially distributed proximal to the exterior surface 38 of the outer cylindrical component 30. The holes 48 are angled towards the axial bore 42.

Furthermore, the mounting flange 46 includes an anti-rotation catch 50, for engagement with a corresponding feature in the dome 22 to prevent rotation of the combustor swirler 26 as will be described in detail furtheron. In the present exemplary embodiment, the anti-rotation catch 50 is provided as a tang extending radially from the mounting flange 46. It should be understood that other alternatives obvious to a person skilled in the art exist.

The inner component 32 has an aerodynamic exterior surface 52 and interior surface 54 respectively and defines an axial bore 56 circumscribed by the interior surface 54. The axial bore 56 is adapted to sealingly receive the fuel nozzle 28. The inner component 32 has a first and a second end 58 and 60 respectively and a flange 62 extending from the exterior surface 52 at a first end 58 thereof.

Figure 5:
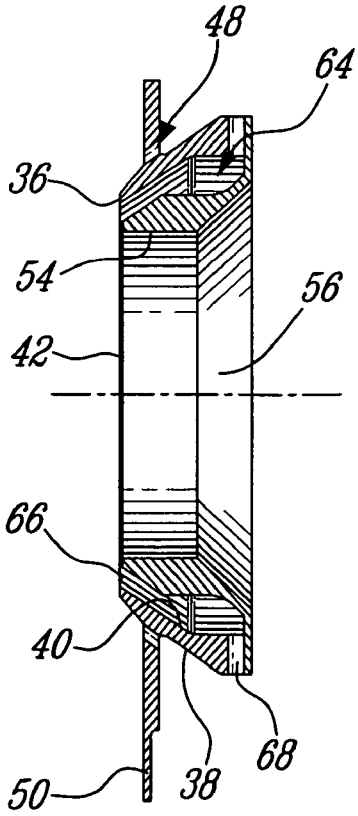
FIG. 5 is a cross-sectional view of the combustor swirler of FIG. 2.

Now referring to FIG. 5, when the outer and inner components 30, 32 are concentrically assembled, an annular gap 64 is defined therebetween. An annular gap opening 66 is defined between the second end 60 of the inner component 32 and the second peripheral edge 36 of the outer cylindrical component 30. The flange 62 of the inner cylindrical component 32 abutting the first peripheral edge 34 of the outer component 30 thereby enclosing the indentations 44 to form aerodynamic fluid flow passages 68 for communicating and swirling a flow of fluid into the annular gap 64. The fluid exiting the annular gap opening 66 mixing with fuel ejected by the fuel nozzle 28 in the combustor 16.

The indentations 44 forming the fluid flow passages 68 are angled and radially offset. By varying the angle and radial offset the swirl strength is also varied such that a given fuel placement within the combustion chamber 20 will result. Thus, by appropriately selecting the slot offset and corresponding aerodynamic swirl strength, the desired radial spray pattern can be achieved. The size of the indentations 44 is chosen such as to achieve a desired stiochiometry in the primary zone of the combustion chamber 20*n* in co-operation with various other fuel nozzle aerodynamic parameters.

Furthermore, to assist in concentrically aligning the outer and inner components 30 and 32 during assembly, alignment means are employed as best shown in FIGS. 3 and 4. The alignment means are provided as detents 70 on flange 62 of the inner component 32 for engagement with the outer component 30 by snap fitting into corresponding grooves 72 provided on the second peripheral edge 36 thereof. Notably, the grooves 72 do not interfere with the indentations 44 on the second peripheral edge 36. The number and shapes of detents can vary. It should be understood that any suitable alignment means may be used.

Now referring to FIG. 2, the assembled combustor swirler 26 mounted to the combustor 16 and engaged with the fuel nozzle 28 is illustrated. In order that the fuel nozzle 28 sealingly engage the combustor swirler 26 while allowing for thermal expansion and contraction of the diameter of the combustor 16, the combustor swirler 26 must be received in the opening 24 defined in the dome 22 such that it is allowed to 'float' on the combustor. Once the fuel nozzle 28 is in place, air pressure acting on the combustor swirler 26 will push the latter against the combustor 16 thereby sealing any leakage past the combustor swirler 26. The mounting flange 46 of the combustor swirler 26 is adapted to be received within the combustion chamber 20 between a pair of rails 74 such that it circumscribes the opening 24. Partial movement of the combustor swirler 26 relative to the combustor 16 is feasible.

More specifically as depicted in FIG. 2, the combustor swirler 26 is trapped within the combustor dome 22 by an outer sheet metal skin 76 and an inner float wall 78 that is bolted to the combustor 16, the skin 76 and the float wall 78 acting as the rails 74. A cut-out 80 in the float wall 78 is provided to receive the anti-rotation catch 50 for restricting swirler rotation. Such a feature is advantageous in reducing the wear of the part by preventing vibration induced spinning.

Figure 6:
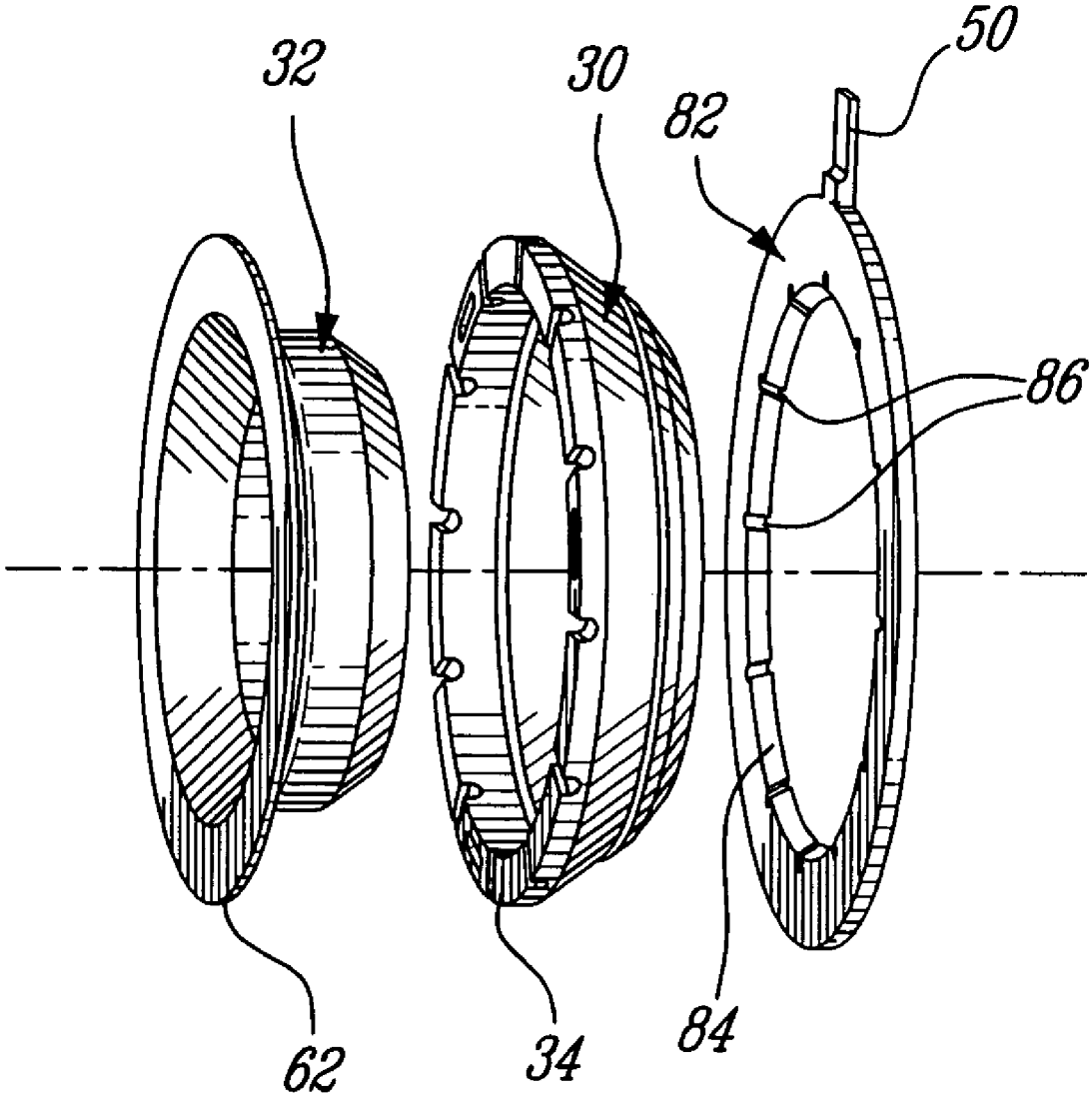
FIG. 6 is an exploded view of a three-piece combustor swirler showing an inner and outer cylindrical component and an annulus.

Now referring to FIG. 6, it can be seen, that the mounting flange 46 can be provided as a separate entity in the form of an annulus identified by reference numeral 82. The annulus 82 has an inside perimeter 84 defining a plurality of indentations 86 in a similar fashion to the indentations 44 defined along the first peripheral edge 34.

When the annulus 82 is assembled to the outer cylindrical component 30, the inside perimeter 84 is in abutting relation with the exterior surface 38 of the outer cylindrical component 30. Thus, the indentations 86 are enclosed thereby forming a fluid flow path for a purge flow as previously described. Again, aligning means such as detents (not shown) can be used between the inside perimeter 84 and the exterior surface 38 for alignment purposes.

The combustor swirler 26 exemplified herein was carefully designed to allow for a manufacturing method that would yield a low cost component and yet provide aerodynamic surfaces of sufficient quality to meet the demands of very high efficiency gas turbine engines. All features of the combustor swirler 26, except for the purge holes in FIGS. 1 to 5, are deliberately designed to exploit metal injection moulding (MIM) manufacturing methods. For example, the utilization of indentations to form aerodynamic air flow passages for swirling and metering the air entering the annular gap rather then conventionally drilled holes illustrates the incorporation of a feature propitiously suited for MIM into the design.

Moreover, MIM processes allow for maintaining tight tolerances with difficult materials, such as high temperature alloys and/or ceramic metal composites. To employ MIM techniques, a special tool (not shown) is designed, into which feedstock, which consists of an atomized metal and a binding agent, is injected through a gate in the tool and then elements of the tool retracted such that the injected component is easily removed. Conventional, angled air feed holes are purposely avoided. Such holes require pins in the tool around which the feedstock is injected. These pins are very small in diameter based on the amount of air required through the combustor swirler. Consequently the pins are susceptible to bending since injection moulding is performed at high pressures. Furthermore, the pins would need to be individually retracted since the holes are angled. As a result using angled holes in an injection-moulded swirler is not considered cost effective and robust from a process perspective. Alternatively, the use of enclosed indentations to swirl and meter the air entering the annular gap allow for a design that can be readily produced by MIM.

Particularly, one way in which the indentations can be produced is by injecting feedstock into a tool followed by simple axial and/or radial withdrawal thereof, allowing for easy part removal.

Therefore, a method of manufacturing the combustor swirler 26 comprises the steps of metal injection moulding the inner component 32 having flange 62 at first end 58 and the outer component 30 having the plurality of circumferentially distributed indentations 44 defined along the first peripheral edge 34. The method of manufacturing further comprises assembling the inner component 32 coaxially with the outer component 30 such that the flange 62 abuts the first peripheral edge of the outer component enclosing the indentations 44 to form radial fluid flow passages. Each of the two components is injected separately: into separate tools and may be oversized.

The method can further comprise the step of producing a seamless interface between the abutting surfaces of the inner and outer component 32 and 30. The seamless interface can be produced by co-sintering the inner and outer component 32 and 30 to yield a single inseparable combustor swirler 26.

Still further, the inner and outer component 32 and 30 can be partially deboud. Debinding is achieved by placing the inner and outer component 32 and 30 in an aqueous solution. The solution is selected in corresponding relation to the binding agent employed during MIM. Remaining binder is removed by co-sintering parts to get one inseparable piece. Parts can be individually sintered but would then require brazing or welding to attach them subsequently. At this stage the components shrink to their final intended size. Subsequently the inner and outer component 32 and 30 are assembled and co-sintered to form a single densified inseparable final piece as above-mentioned. Once successful sintering is complete, no metallurgical boundary exists at the mating interface of the inner and outer component 32 and 30.

Advantageously, the detents 70 provide additional surface area for co-sintering and enhance the strength of the attachment between the inner and outer component 32 and 30 during sintering. However, the detents 70 are designed such that they can be readily moulded and thus involve no additional cost.

Moreover, the sintered combustor swirler 26 can further be hot isostatically pressed (HIP) to achieve full densification, and thus, superior material properties. Any remaining vestige at gating surfaces can also be removed by various low cost finishing methods.

In the case of FIG. 6 in which three components are involved, the same method of manufacturing applies. Each component is individually injected and then the three components are simultaneously co-sintered. However, co-sintered attachment is along two surfaces as opposed to just one. With the indentations 86 defined along the inside perimeter 84 of the annulus 82, the annulus can be easily moulded and does not need to be later drilled.

The result of this design and corresponding manufacturing method is a low cost component with superior quality. Advantageously, the manufacturing process is readily repeatable, thus the part exhibits very reproducible airflow results. In the exemplified method of manufacturing, no brazing or welding is required to produce a seamless interface between the inner and outer component 32 and 30 and no finishing or deburring is required to finalize the enclosed indentations on the injection moulded part. What's more, any number of indentations can be chosen with no extra recurring cost involved in moulding as the combustor swirler design exemplified herein is propitiously suited for MIM manufacturing methods.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of manufacturing a combustor swirler for a gas turbine engine comprising: metal injection moulding an inner component, the inner component defining an inner cavity adapted to receive a fuel nozzle, metal injection moulding an outer component adapted to be fitted over the inner component; one of said inner and said outer components being moulded with a series of slots in a surface thereof, sealing the slots to form corresponding fluid flow passages by assembling the inner component coaxially with the outer component, wherein the inner and outer components are moulded with interlocking features, and wherein the method further comprises engaging said interlocking features together, to maintain the inner and outer component in alignment during assembly.

2. The method as defined in claim 1, wherein the inner component is moulded with a flange at one end thereof, wherein the slots are defined along one peripheral edge of the outer component; and wherein the slots are sealed by engaging the flange of the inner component with the peripheral edge of the outer component.

3. The method as defined in claim 1, wherein assembling the inner and outer components includes producing a seamless interface between corresponding abutting surfaces of the inner and outer components.

4. The method as defined in claim 3, wherein producing a seamless interface includes co-sintering the inner and outer components yielding a single inseparable combustor swirler.

5. The method as defined in claim 4, further comprising at least partially debinding the inner and outer components.

6. The method as defined in claim 5, wherein the step of partially debinding is achieved by placing the inner and outer components in an aqueous solution and selecting the aqueous solution in corresponding relation to a binding agent employed during metal injection moulding.

7. The method as defined in claim 4, further comprising independently sintering the inner and outer components prior to co-sintering.

8. The method as defined in claim 7, further comprising hot isostatically pressing the combustion swirler following co-sintering of the inner and outer components.

9. The method as defined in claim 1, further comprising: metal injection moulding an annulus, one of the annulus and the outer component having a plurality of indentations defined along a surface thereof, and assembling the annulus about the outer component so as to seal said indentations and form a series of corresponding purge holes between the annulus and the outer component.

10. The method as defined in claim 9, wherein the indentations are defined in an inside perimeter of the annulus.

11. The method as defined in claim 9, comprising co-sintering the inner and outer components and the annulus yielding a single inseparable combustor swirler.

12. The method as defined in claim 1, wherein assembling the inner and outer component comprises forming an annular gap therebetween, said fluid flow passages being in fluid flow communication with said annular gap.

13. The method as defined in claim 1, wherein the slots are radially oriented.

14. The method as defined in claim 1, wherein the interlocking features include complementary moulded detents.

* * * * *